US007424950B2

(12) United States Patent
Burgess et al.

(10) Patent No.: US 7,424,950 B2
(45) Date of Patent: Sep. 16, 2008

(54) GOLF BAG CARRIER WITH PROTECTIVE GOLF CLUB HEAD ENCLOSURE

(75) Inventors: Andrew A. Burgess, Glendale, MO (US); Martha A. Lopacki, Chesterfield, MO (US)

(73) Assignee: TRG Accessories, L.L.C., St. Louis, MO (US)

( * ) Notice: Subject to any disclaimer, the term of this patent is extended or adjusted under 35 U.S.C. 154(b) by 642 days.

(21) Appl. No.: 10/768,547

(22) Filed: Jan. 30, 2004

(65) Prior Publication Data

US 2005/0167303 A1 Aug. 4, 2005

(51) Int. Cl.
*A63B 55/00* (2006.01)

(52) U.S. Cl. ..... 206/315.3; 150/159; 190/18 A

(58) Field of Classification Search ..... 206/315.3; 150/159; 190/109, 110, 20; 224/635–655
See application file for complete search history.

(56) References Cited

U.S. PATENT DOCUMENTS 1,437,349 A * 11/1922 Moore, Jr. ..... 206/315.6
1,563,816 A * 12/1925 Worthington ..... 206/315.2
1,612,741 A * 12/1926 Newman-Butler ..... 224/613
2,471,169 A * 5/1949 Salzberg et al. ..... 206/315.4
2,739,631 A * 3/1956 Hamley ..... 224/657
3,245,448 A * 4/1966 Rea ..... 206/315.1
4,091,977 A 5/1978 Luttbeg
4,878,585 A * 11/1989 Orestano ..... 211/87.01
4,951,818 A * 8/1990 Johnson ..... 206/315.1
5,135,222 A * 8/1992 Spector ..... 473/576
5,265,894 A 11/1993 Dunn
D349,402 S 8/1994 Fiore
5,515,897 A 5/1996 Fehan
5,695,067 A * 12/1997 Harvey ..... 206/579
6,039,243 A * 3/2000 Lickton ..... 229/117.01
6,161,698 A * 12/2000 Bradshaw et al. ..... 206/527
6,315,115 B1 11/2001 Bradshaw et al.
6,330,944 B1 * 12/2001 DeMichele ..... 206/315.3
6,446,851 B1 * 9/2002 Parks et al. ..... 224/655
6,494,352 B1 12/2002 Mullen
6,612,412 B2 9/2003 Sanderson et al.
6,640,970 B1 * 11/2003 Townsend, Jr. ..... 206/315.2
6,874,628 B2 * 4/2005 Hammill ..... 206/317
2002/0144917 A1 * 10/2002 Barrise et al. ..... 206/315.3

* cited by examiner

*Primary Examiner*—Tri M Mai
(74) *Attorney, Agent, or Firm*—Armstrong Teasdale LLP

(57) ABSTRACT

A golf bag carrier includes a body and a golf club protection assembly. The body extends along a longitudinal axis and defines a cavity adapted to contain a golf bag with a set of golf clubs therein. The golf club protection assembly is adapted to protect the golf club shafts and the golf club heads. The protection assembly includes a helmet configured to extend over the top of the golf club heads and adapted to constrain the golf clubs from moving in a direction along the longitudinal axis, and a protective member configured to extend circumferentially around the golf bag and clubs.

6 Claims, 7 Drawing Sheets

GOLF BAG CARRIER WITH PROTECTIVE GOLF CLUB HEAD ENCLOSURE

BACKGROUND OF THE INVENTION

This invention relates generally to golf bags, and more particularly, to golf bag carriers with club head protection that facilitates the transportation of golf clubs and accessories.

A major source of damage to golf bags and clubs is travel, particularly on airlines. Golfers frequently like to bring their golf clubs when traveling on vacation or traveling where they have an opportunity to play golf. When stored as luggage on commercial transporters, the golf bags are subjected to various forces and orientations by baggage handlers. This can result in golf bags and associated clubs being exposed to harsh bending and scraping forces. Thus, most golfers use some type of travel cover or carrier for transporting their golf clubs.

Known golf bag carriers range from thin nylon shells to hard cover cases. The thin nylon shell carriers are desirable because they are light in weight and easy to use. However, many of the thin nylon shell carriers provide little, if any, protection for the golf clubs. The hard shell cases, on the other hand, may adequately protect golf clubs, but they are heavy and generally cumbersome to use and, thus, less desirable.

Hence, soft or padded shell carriers have grown in popularity due to their lightweight construction and their ability to provide the golf clubs more protection than the nylon shell carriers. However, even these carriers do not always provide sufficient protection to the golf clubs during transport. Even when adequate padding is present, movement of the golf clubs relative to the padding as the carrier is handled may expose the clubs to damage.

BRIEF DESCRIPTION OF THE INVENTION

According to an exemplary embodiment of the present invention, a golf bag carrier is provided. The golf bag carrier comprises a body having a longitudinal axis and defining a cavity adapted to contain a golf bag with a set of golf clubs therein. A helmet is attached to the body within the cavity. The helmet is configured to extend over the top of the heads of the golf clubs and is adapted to constrain the golf clubs from moving in a direction along the longitudinal axis.

In another exemplary embodiment, a golf bag carrier is provided. The golf bag carrier comprises a body having a longitudinal axis and defining a cavity adapted to contain a golf bag with a set of golf clubs therein. The body comprises at least one sleeve within the cavity, and a protective member is received in the sleeve. The protective member has a first free end and a second free end. The first free end is configured to extend circumferentially around the golf bag and the second free end is also configured to extend circumferentially around the golf bag.

In yet another exemplary embodiment, a golf bag carrier is provided. The golf bag carrier comprises a body and a golf club protection assembly. The body extends along a longitudinal axis and defines a cavity adapted to contain a golf bag with a set of golf clubs therein. The golf club protection assembly is adapted to protect the golf club shafts and the golf club heads. The protection assembly includes a helmet configured to extend over the top of the golf club heads and adapted to constrain the golf clubs from moving in a direction along the longitudinal axis, and a protective member configured to extend circumferentially around the golf bag and clubs.

DETAILED DESCRIPTION OF THE INVENTION

Figure 1:
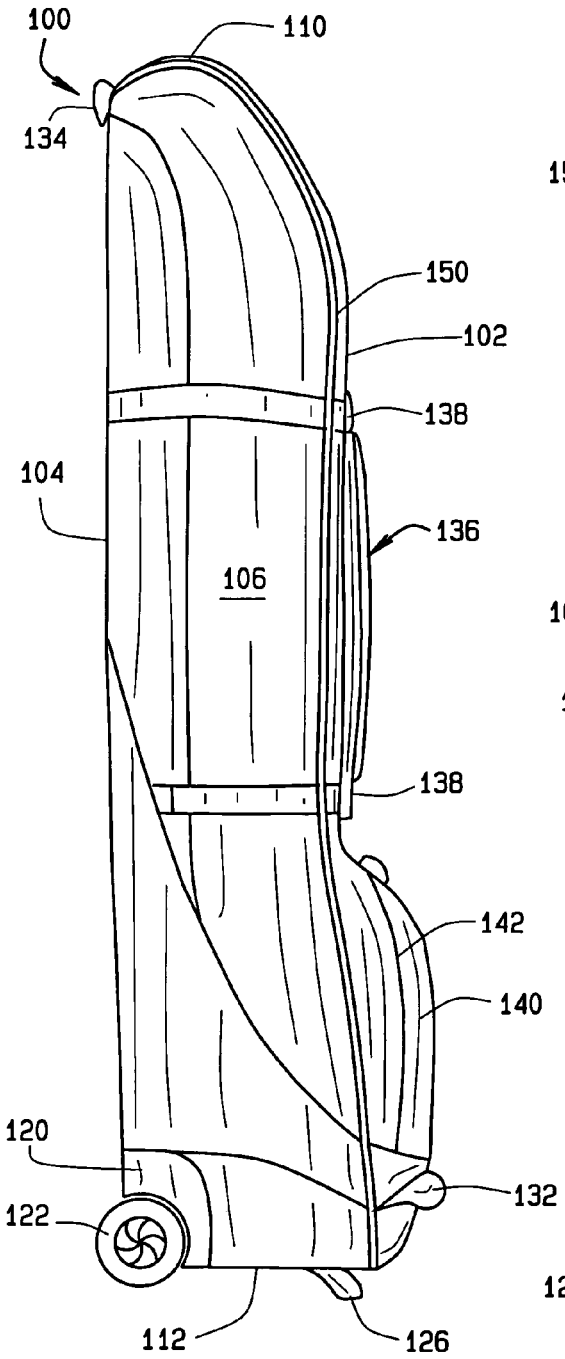
FIG. 1 is side elevational view of an exemplary golf bag carrier according to the present invention.
Figure 2:
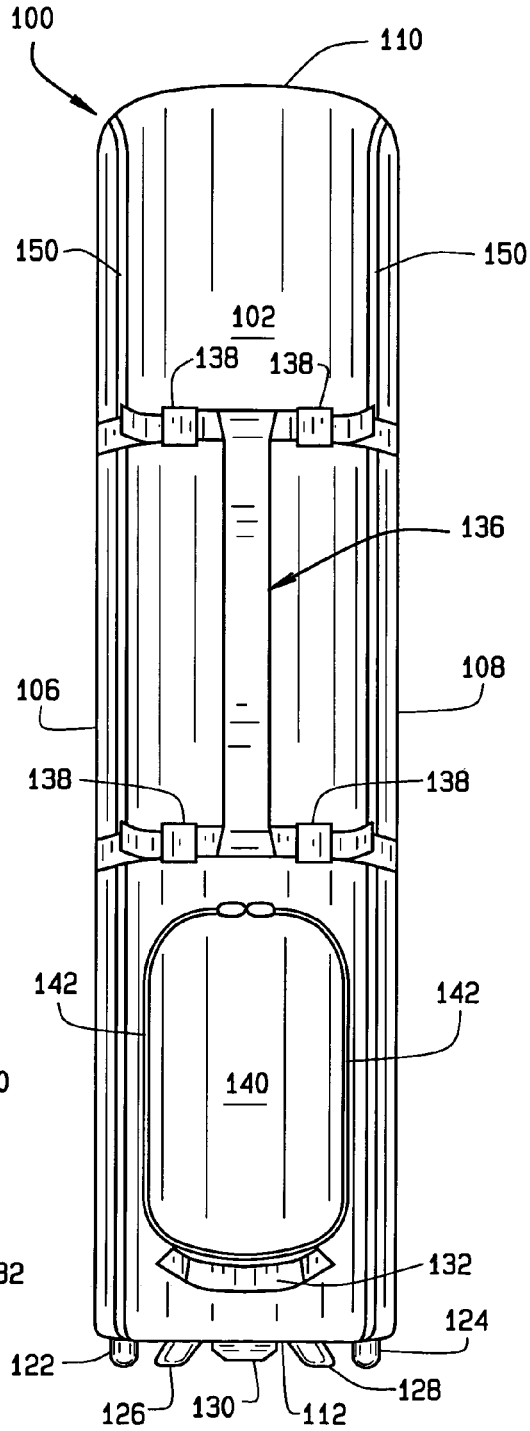
FIG. 2 is front elevational view of the golf bag carrier shown in FIG. 1.
Figure 3:
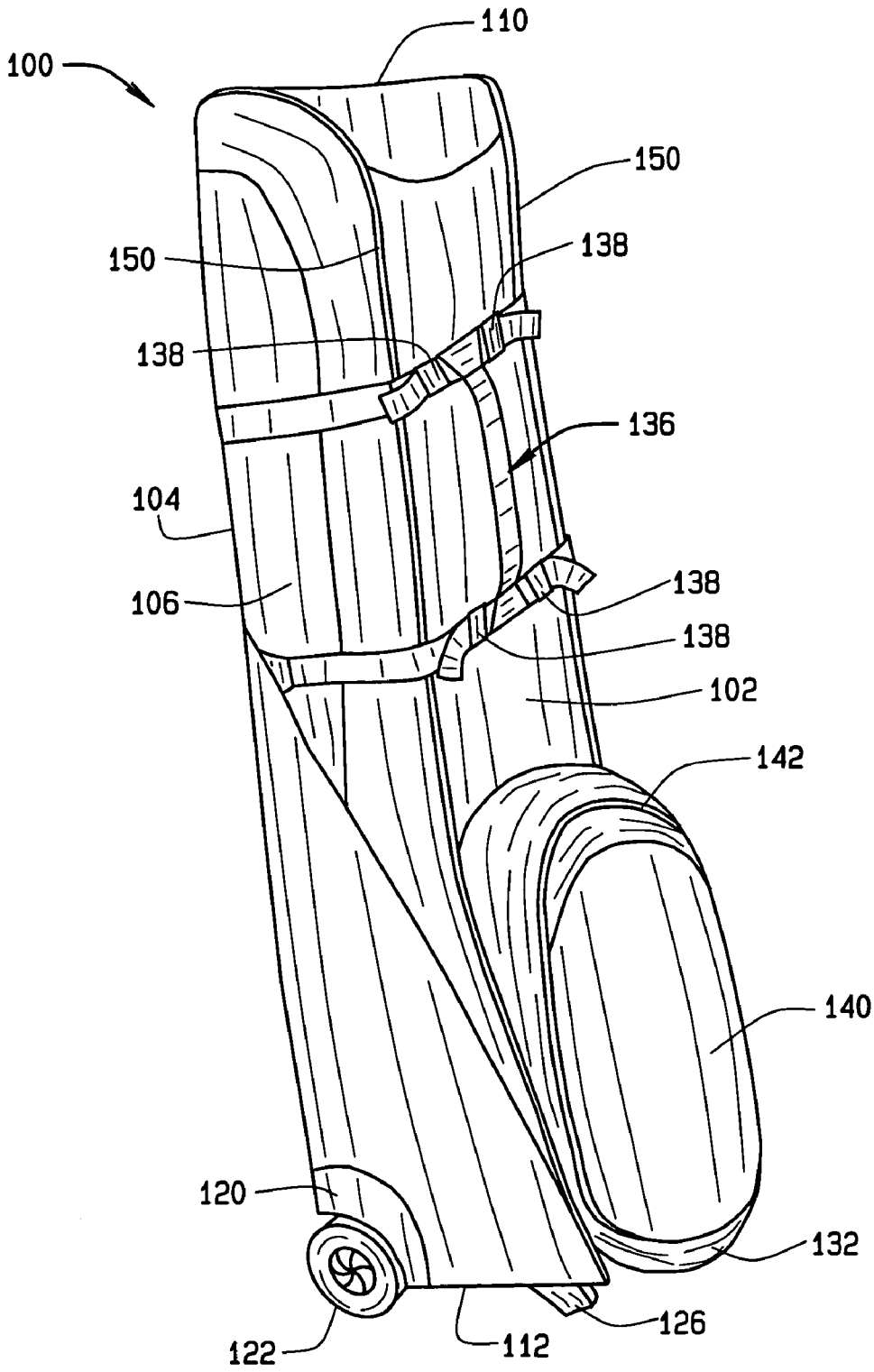
FIG. 3 is perspective elevational view of the golf bag carrier shown in FIGS. 1 and 2.
Figure 5:
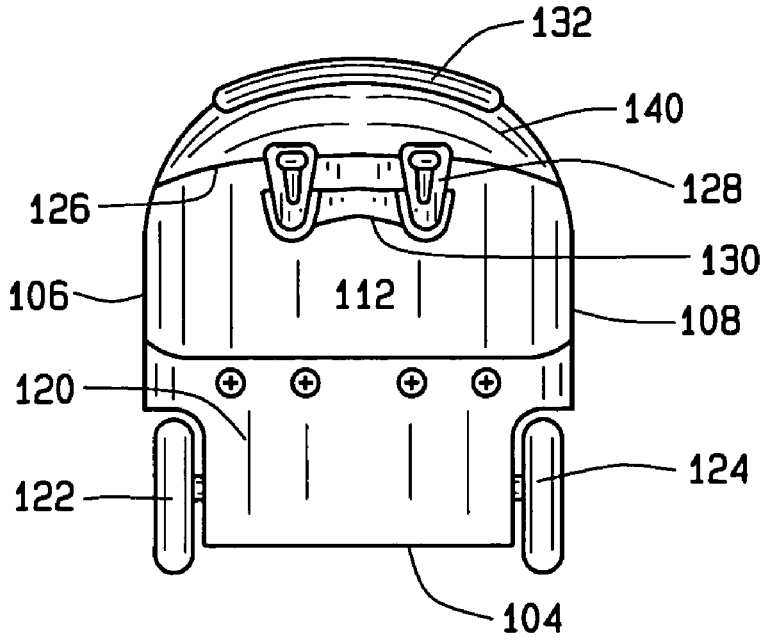
FIG. 5 is a bottom plan view of the golf bag carrier shown in FIG. 1.

Referring now to the drawings, FIGS. 1, 2 and 3 show the front, side and perspective view respectively of a golf bag carrier 100 according to an exemplary embodiment of the present invention. The golf bag carrier 100 includes an elongated, flexible body 214 having a generally rectangular shape with opposing front and rear portions 102 and 104, opposing side portions 106 and 108, and opposing top and bottom portions 110 and 112 which in an exemplary embodiment are fabricated from of a flexible material. Bottom portion 112 has a rigid wheel casing 120 attached, located at the rear portion 104 of the carrier 100. Bottom portion 112 may be fabricated from, for example, plastic and is best seen in FIG. 5. Attached to the wheel casing 120 is a pair of wheels 122 and 124 located on each side 106 and 108 of the golf bag carrier 100. The wheels 122 and 124 are used to help transport the golf bag carrier 100, and in an exemplary embodiment are fabricated from plastic. Bottom portion 112 also has two legs 126 and 128 which allow the golf bag carrier 100 to stand upright and a rigid bottom handle 130 which aids in carrying, lifting or moving the golf bag carrier. The legs 126 and 128 and handle 130 may be fabricated from plastic for example, or other known suitable materials in the art.

Figure 4:
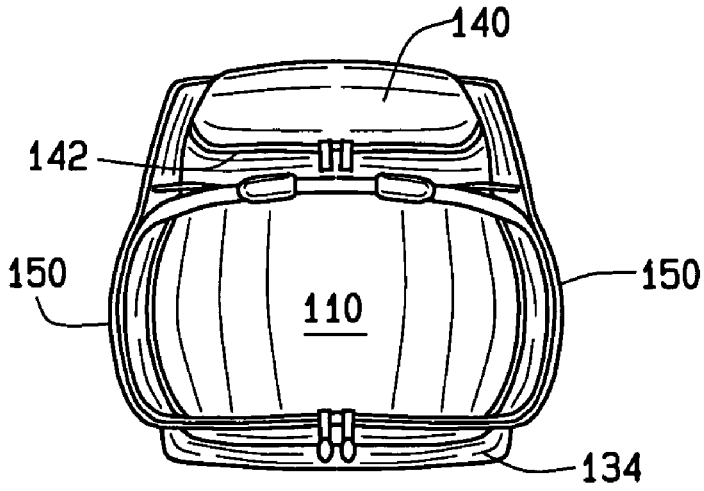
FIG. 4 is a top plan view of the golf bag carrier shown in FIG. 1.

The top portion 110 of the golf bag carrier 100 is best seen in FIG. 4. The top portion 110 includes an upper handle 134 which can be used in carrying, lifting, moving or rolling the golf bag carrier 100.

The front portion 102 of the golf bag carrier 100 includes a storage pouch 140 located near the bottom portion 112 of the golf bag carrier 100. The storage pouch 140 is accessed through a storage pouch zipper member 142. The front portion 102 also includes a lower handle 132 at or near the bottom portion 112 of the golf bag carrier 100. The lower handle 132 is used to help a user to carry, lift, or move the golf bag carrier 100.

The golf bag carrier 100 further contains a carrying strap assembly 136 which is located at or near the middle of the front portion 102. In the embodiment shown in FIGS. 1, 2 and 3, the carrying strap assembly 136 utilizes multiple carrying strap locking clips 138 to fasten the carrying strap assembly 136 together, however, in another embodiment, alternative fasteners such as a belt, Velcro™, zipper, or snaps, for example, could be utilized.

The front portion 102 is attached to the side portions 106 and 108 via a zipper member 150. In the embodiment shown in FIGS. 1-4, the zipper member 150 extends from the bottom portion 112 up and around the top portion 110 and back down to the bottom portion 112 on the opposing side as one continuous unit. In alternative embodiments, the golf bag carrier 100 may have more than one zipper member, or the zipper member may open in a different fashion, such as, for example, where the zipper extends along only one side of the golf bag carrier 100 and then across the golf bag carrier 100 to define an opening to insert or remove a golf bag from the golf club carrier 100.

Figure 10:
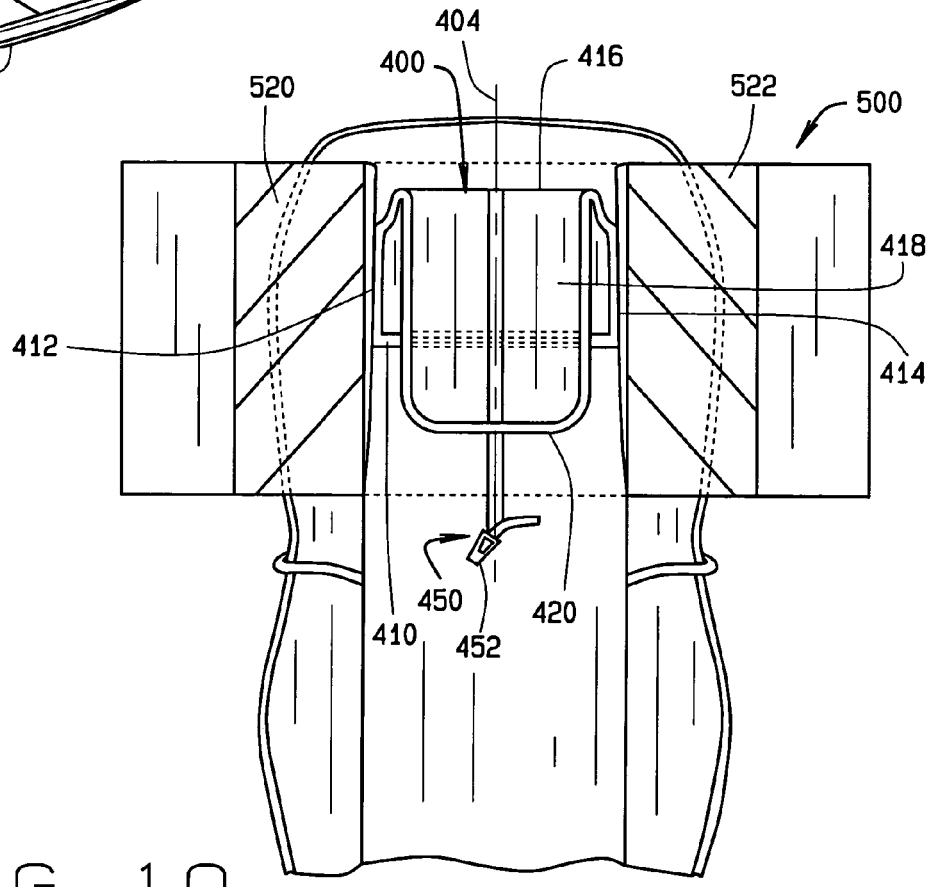
FIG. 10 is a view similar to FIG. 6, illustrating another feature of the golf bag carrier.
Figure 11:
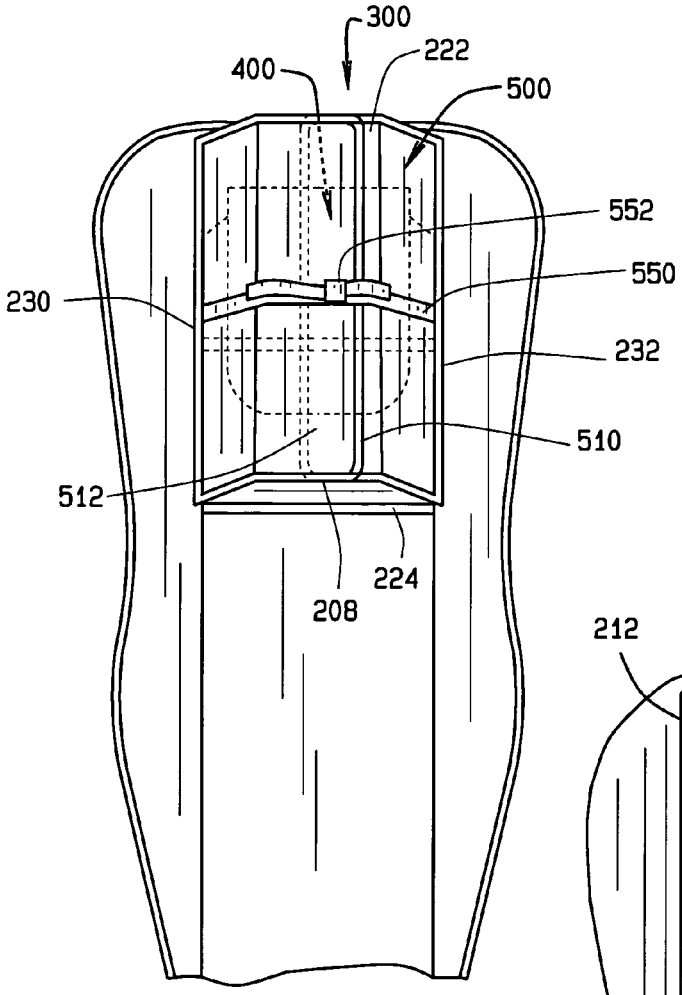
FIG. 11 illustrates a portion of the golf bag carrier in a traveling state.
Figure 12:
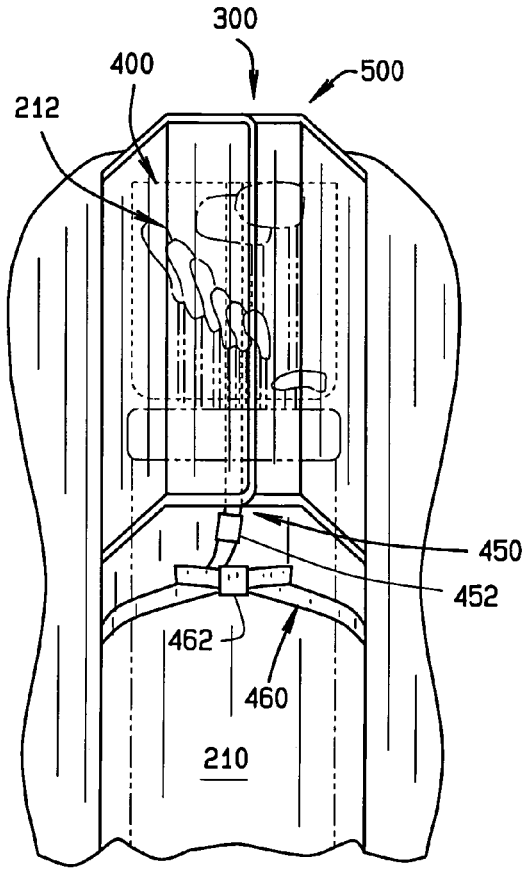
FIG. 12 is a view similar to FIG. 11, but illustrating a golf bag situated in the golf bag carrier.

FIGS. 6, and 9-12 illustrate the golf bag carrier 100 in an open position exposing a carrier cavity 200. The carrier cavity 200 is adapted to contain a golf bag with a set of golf clubs therein (as shown in FIG. 12). In one embodiment, the golf bag carrier 100 contains a golf club protection assembly 300 which has additional protection for the golf bag and golf clubs including a protective helmet 400 which protects the top, or heads, of the golf clubs and a protective member 500 which protects the golf bag, the shafts of the golf clubs, and the sides of the golf club heads, as explained below.

Figure 6:
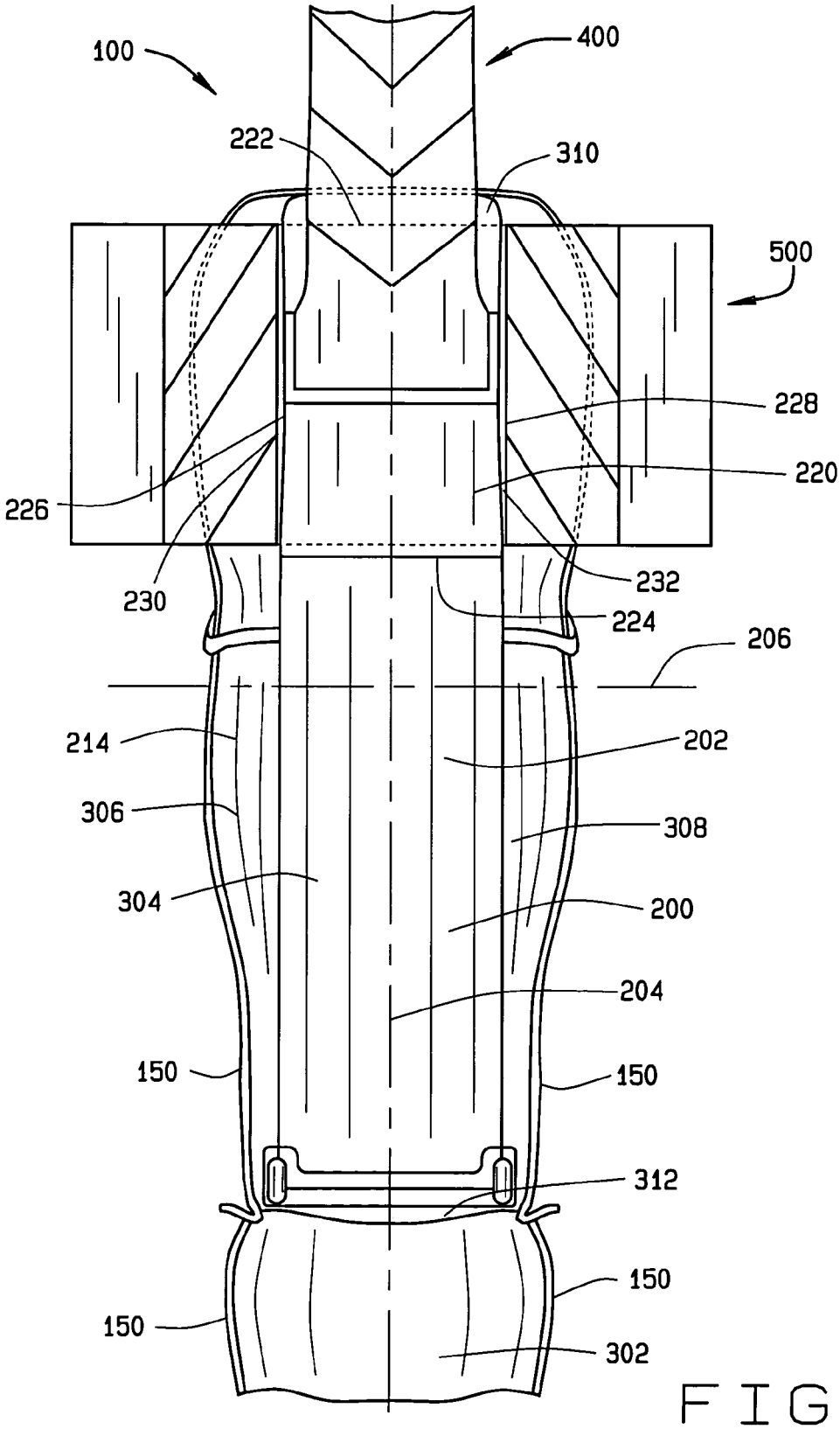
FIG. 6 is a front view of the golf bag carrier in an open position.

FIG. 6 illustrates the golf bag carrier 100 in an open position exposing the carrier cavity 200. In an exemplary embodiment, the body 214 has a substantially planar bottom 202 which corresponds to the inner layer of the rear portion 304 of the golf bag carrier 100. For purposes of explanation, the body 214 of the golf bag carrier 100 is defined by a standard X-Y-Z coordinate system. The planar bottom 202 is substantially parallel to a plane defined by the intersection of the longitudinal axis 204 of the golf bag and the lateral axis 206 of the golf bag which correspond to the X and Y axes respectively. The Z axis extends perpendicular to the X and Y axes, and corresponds to the depth of the carrier cavity 202 as illustrated in FIG. 6. Each of the X, Y, and Z axes of the golf bag carrier 100 corresponds to the axes of a golf bag (not shown in FIG. 6) in use.

The carrier cavity 200 is further defined by inner layers of the rear portion 304, the opposing top and bottom portions 310 and 312, and the opposing side portions 306 and 308. In one embodiment, as shown in FIG. 6, the front portion inner layer 302 is attached to the bottom portion inner layer 312 of the golf bag carrier 100 and is flipped open to expose the carrier cavity 202. In order to enclose the carrier cavity 202 again, the front portion inner layer 302 is secured to the top portion inner layer 310 and the side portion inner layers 306 and 308 via a zipper member 150.

The body 214 of the golf bag carrier 100 contains a sleeve 220 which is positioned near the top portion inner layer 310 of the golf bag carrier 100. The sleeve 220 has an opposing top end 222 and bottom end 224 and opposing sides 226 and 228. The sleeve 220 is formed by fastening the top end 222 and the bottom end 224 to the rear portion inner layer 304 of the golf bag carrier 100. In one embodiment, the top end 222 and the bottom end 224 are stitched or otherwise fastened by sewing action. In alternative embodiments other fasteners, such as, for example, glue, Velcro™, snaps, rivets or screws may be employed to secure the top end 222 and the bottom end 224 of the sleeve 220 to the rear portion inner layer 304 of the golf bag carrier 100. By only fastening the top end 222 and the bottom end 224, the opposing sides 226 and 228 of the sleeve 220 remain free, forming slots 230 and 232 which allow a protective member 500 to pass between the sleeve 220 and the rear portion inner layer 304 of the golf bag carrier 100 to a desired position. Such a protective member 500 is sometimes also referred to herein as a wingspan member.

Figure 7:
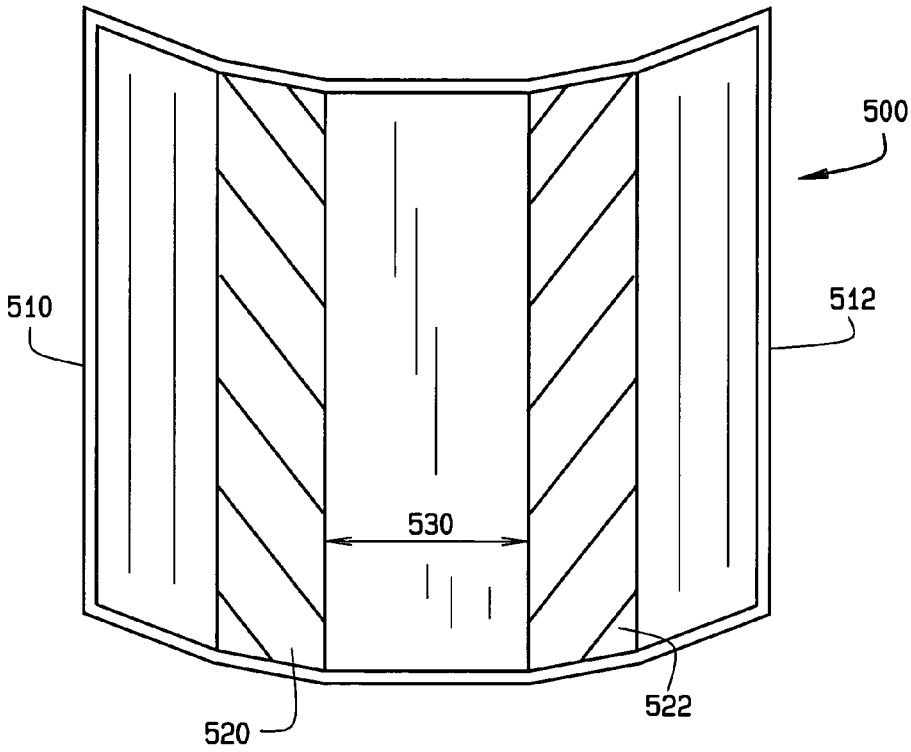
FIG. 7 is a front view of a protective member for use with the golf bag carrier shown in FIGS. 1-6.
Figure 8:
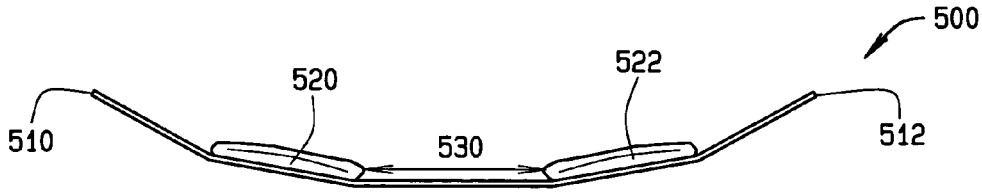
FIG. 8 is a side elevational view of the protective member shown in FIG. 7.
Figure 9:
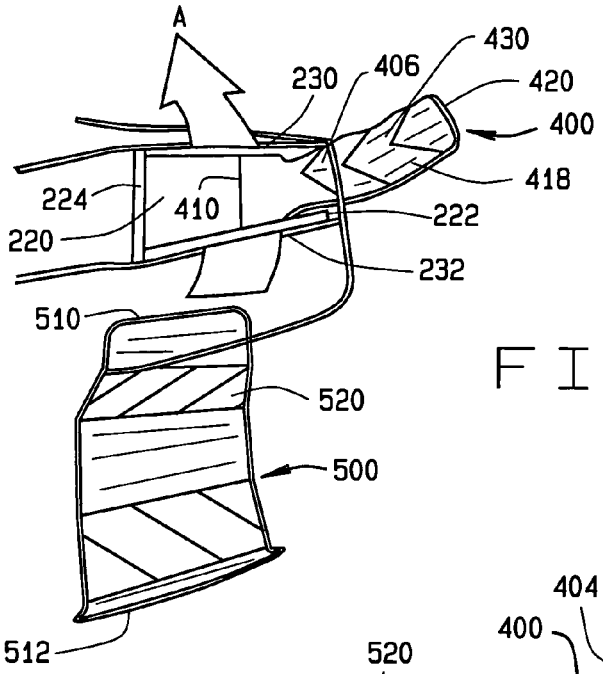
FIG. 9 is an assembly view of the protective member shown in FIGS. 7 and 8 with the golf bag carrier.

The protective member 500 is best seen in FIGS. 7 and 8. The protective member 500 includes a first free end 510 and a second free end 512 and at least one protective layer 520. The protective member 500 is ultimately utilized by inserting the first free end 510 into the sleeve 220, as described above, and passing the protective member 500 between the sleeve 220 and the rear portion inner layer 304 of the golf bag carrier 100. The protective member 500 can be slid through the sleeve 220 until the protective layers 520 and 522 of the protective member 500 are positioned such that when the first free end 510 and the second free end 512 are folded over or wrapped around the circumference of the golf bag containing the golf clubs, the protective layers 520 and 522 contact the golf bag, the golf club shafts and the sides of the golf club heads. As such, the protective layers 520 and 522 protect the golf clubs from damage during transportation of the golf bag carrier 100.

In use, the first free end 510 of the wingspan member 500 passes through the sleeve 220 in a direction substantially parallel to the planar bottom 202, or X-Y plane, to a desired position. The first free end 510 and the second free end 512 are then extended circumferentially, or folded or wrapped around the circumference of the golf bag, by moving the ends in a direction that extends radially around the longitudinal axis of the golf bag. In other words, the protective member ends 510 and 512 may be moved initially in a direction which is substantially parallel to the Z axis and secondarily in a direction which is substantially parallel to the lateral axis 206, or X-axis. As such, the first free end 510 is moved toward the second free end 512 and the second free end 512 is moved toward the first free end 510 so that the second free end 512 overlaps the first free end 510, thereby forming a protective enclosure 208. Alternatively, the first free end 510 can overlap the second free end 512.

In one embodiment, the wingspan member 500 has two protective layers 520 and 522 spaced apart by a length 530 substantially equal to the width of the sleeve 220. The protective layers 520 and 522 include a cushion or pillow-like material for example, and in an exemplary embodiment are fastened to the wingspan member 500 by a sewing action, but other forms of fastening are realized. The wingspan member 500 is fabricated from a material which is capable of being bent around the golf bag and golf clubs, such as a plastic material.

Further, in an illustrative embodiment, another protective member, such as a helmet member 400, sometimes referred to hereafter as a helmet, is positioned in the carrier cavity 200 for further protection of a golf bag and associated golf clubs. The helmet 400 protects the top, or heads, of the golf clubs by constraining the golf clubs from movement in a direction parallel to the longitudinal axis 204 of the golf bag. In an exemplary embodiment, the helmet 400 has a first end 410 which is fixed to the golf bag carrier 100 and a second end 420 that is free to wrap around or fold over the top, or heads, of the golf clubs. The helmet 400 can be attached to the body 214 of the golf bag carrier 100, and as shown in FIG. 10, the helmet 400 can also be attached to the sleeve 220.

In one embodiment, as shown in FIG. 10, the helmet member 400 includes a centerline 404, a head portion 416 and a shaft portion 418. The helmet 400 is oriented in a position that is substantially parallel to the planar bottom 202, or X-Y plane, when the golf bag is inserted into the golf bag carrier 100. The free end 420 is then configured to extend initially over the top of the heads of the golf clubs and secondarily along the side of the golf club heads and the shafts of the golf clubs so that when the helmet 400 is extended, the centerline of the helmet 400 remains substantially parallel to the Y-Z plane of the golf bag carrier body 214. As such, the head portion 416 of the helmet 400 is positioned so that it is engaging the top of the heads of the golf clubs and the shaft portion 418 of the helmet 400 is engaging the sides of the golf club heads and the shafts of the golf clubs. In other words, the head portion 416 of the helmet 400 is extended in a direction substantially parallel to the Z-axis and engages the top, or heads, of the golf clubs, thereby restricting the movement of the clubs in a direction substantially parallel to the longitudinal axis 204, and the shaft portion 418 of the helmet 400 is extended in a direction substantially parallel to the planar bottom 202 and engages the sides of the golf clubs, the shafts of the golf clubs, and part of the golf bag. In use, the free end 420 of the helmet 400 is moved in a direction transverse to the planar bottom 202, such as in a direction which is substantially parallel to the Z axis. The free end 420 of the helmet 400 is thereafter moved toward the golf clubs in a direction which is once again substantially parallel to the longitudinal axis 204 of the planar bottom 202, thereby forming a protective enclosure 208 around the golf clubs.

The helmet 400, like the wingspan member 500, has a protective layer 430 which is positioned on the helmet 400 to contact the golf clubs. In one embodiment, the entire inner layer of the helmet 400 is lined with the protective layer 430, which is, for example, a soft cushion or padded material fastened to the helmet 400 by a sewing action, although other fasteners may likewise be employed in alternative embodiments. In another embodiment, the protective layer 430 is positioned on the helmet 400 only on the section of the helmet 400 that contacts the golf clubs. The helmet 400 is attached to the sleeve 220 by a sewing action across the helmet first end 410, and can additionally be attached to a portion of the sides 412 and 414 of the helmet 400 for added stability. The helmet free end 420 is capable of being wrapped around or folded over the top, or heads, of the golf clubs, thereby securing and protecting the golf clubs during transportation and adapted to limit the movement of the golf clubs in a longitudinal direction.

In one embodiment, a helmet locking assembly 450 is attached to the helmet free end 420. This helmet locking assembly 450 can be any known fastener, such as a belt and buckle mechanism, Velcro™, a snapping mechanism, or a locking clip as shown in FIG. 10. In one embodiment, the helmet locking assembly 450 is adjustable to facilitate the tightening and loosening of the helmet 400 around the golf clubs to obtain an appropriate level of protection, or to compensate for different sized clubs. The helmet locking assembly 450 is also adjustable to facilitate the tightening of the helmet 400 so that the protective layer 430 contacts every golf club thereby protecting all of the golf clubs in the golf bags, not just the golf clubs around the perimeter of the golf bag. In the embodiment shown in the drawings, the helmet locking clip 452 is further attached to a golf bag locking assembly 460 which wraps around the sides of the golf bag 210 to further secure the golf bag 210 to the golf bag carrier 100. This golf bag locking assembly 460 is connected to the helmet locking assembly 450 by a helmet locking clip 452 as is best seen in FIG. 12.

In an exemplary embodiment, a protective member locking assembly 550 is provided to secure the wingspan member 500. The protective member locking assembly 550, as shown in FIG. 11, contains a protective member locking clip 552. Other fasteners are contemplated, however, in alternative embodiments. The protective member locking clip 552 is adjustable to facilitate the tightening and loosening of the wingspan member 500 around the golf clubs 212 to obtain an appropriate level of protection so that the golf clubs do not move around inside the golf bag during transportation, or to compensate for different sized clubs. In one embodiment, the straps 554 and 556 of the protective member locking assembly 550 are attached to the golf bag carrier 100 near the slots 230 and 232 on either side of the golf bag carrier 100. In an alternative embodiment, the straps 554 and 556 are attached to the wingspan member 500 itself and are inserted through the sleeve 220 along with the wingspan member 500.

FIG. 11 shows a protective enclosure 208, and FIG. 12 shows the golf clubs 212 positioned inside the protective enclosure 208. In one embodiment, the protective enclosure 208 is formed as generally described above, namely by opening the golf bag carrier 100 by unzipping the golf bag carrier 100 and folding back the front portion 102 of the golf bag carrier 100 revealing the carrier cavity 200. The wingspan member 500 is then inserted into the sleeve 220. The golf bag 210 is placed into the carrier cavity 200, where the golf bag 210 is secured in place by the golf bag locking assembly 460. The protective helmet 400 is folded over the top, or heads, of the golf clubs 212, and secured into place with the helmet locking assembly 450. The wingspan member 500 is wrapped around the sides of the golf clubs 212 and secured with the protective member locking assembly 550. The protective helmet 400 and wingspan member 500 thereby form the protective enclosure 208 around the golf clubs 212.

As shown above, a golf bag carrier that is relatively lightweight, that provides sufficient protection for golf clubs during transportation and that is constructed in a manner to provide more protection for the clubs during rough handling and without adding significant weight to the bag has been described.

While the invention has been described in terms of various specific embodiments, those skilled in the art will recognize that the invention can be practiced with modification within the spirit and scope of the claims.

What is claimed is:

1. A golf bag carrier for transporting a golf bag and a plurality of golf clubs, each of the respective golf clubs having elongated shafts and golf club heads, the golf bag having a body and the shafts being situated in the golf bag with the golf club heads extending from the body, the golf bag carrier comprising:

an elongated body carrier body having a carrier cavity shaped to accept and generally surround the golf bag and the clubs; and a golf club protection assembly coupled to the carrier and securing the golf club heads within the carrier cavity, the golf bag protection assembly comprising an adjustable protective helmet extendible over the heads of the golf clubs to engage and secure a top surface of the heads of the golf clubs and, and a protective member extendible about the golf club heads to engage and secure the side surfaces of the golf club heads, the helmet and the protective member collectively defining a protective enclosure for the golf club heads;

wherein the carrier body comprises a sleeve situated in the carrier cavity, the protective member passing through the sleeve.

2. The golf bag carrier of claim 1, wherein the carrier body is generally flexible.

3. The golf bag carrier of claim 1, wherein at least one of the helmet and the protective member includes a locking assembly.

4. The golf bag carrier of claim 1, wherein the protective member comprises a first free end, a second free end, and a length between the first free end and the second free end, the length of the protective member extendible around and generally conformable to a circumference of the golf bag.

5. The golf bag carrier of claim 1, wherein the helmet includes a head portion and a shaft portion, the head and shaft portions foldable over the exposed golf club heads to secure the heads and portions of the shafts of the golf clubs proximate the heads, whereby the golf clubs are prevented from axial movement within the carrier cavity.

6. The golf bag carrier of claim 1, further comprising a wheel casing and at least one wheel.

* * * * *